US005527127A

United States Patent [19]

Junker

[11] Patent Number: 5,527,127

[45] Date of Patent: Jun. 18, 1996

[54] TRAFFIC BARRIER FOR GUIDANCE INSTALLATIONS

[76] Inventor: Wilhelm Junker, Reutliinger Strasse 14, 71522 Backnang, Germany

[21] Appl. No.: 256,898

[22] PCT Filed: Feb. 2, 1993

[86] PCT No.: PCT/EP93/00237

§ 371 Date: Jul. 29, 1994

§ 102(e) Date: Jul. 29, 1994

[87] PCT Pub. No.: W093/15275

PCT Pub. Date: Aug. 5, 1993

[30] Foreign Application Priority Data

Feb. 3, 1992 [DE] Germany ..... 42 02 986.4

[51] Int. Cl.[6] ..... A01K 3/00

[52] U.S. Cl. ..... 404/6; 856/13.1

[58] Field of Search ..... 404/6, 4; 256/1, 256/13.1

[56] References Cited

U.S. PATENT DOCUMENTS 4,463,934 8/1984 Ochoa et al. ..... 404/6 X

FOREIGN PATENT DOCUMENTS

3827030A1 4/1989 Germany .
8915303.0 4/1990 Germany .
3930293A1 3/1991 Germany .
9107263.8 10/1991 Germany .
4202986A1 8/1993 Germany .

*Primary Examiner*—William P. Neuder

[57] ABSTRACT

The traffic barrier used in guidance installations has a longitudinal shape and on its upper surface a first part of a coupling device. A second part is provided on a guide body coupling the same to the traffic barrier. On each end the traffic barrier is provided with parts divided from a further coupling device so that the traffic barrier can be coupled to a neighboring traffic barrier in a longitudinal direction. The traffic barrier has a cross-section wherein the outline of the side walls and the upper wall is contiguous with a circumferential curve being at least almost constant in its outline and being substantially convex in its outline but can extend linearly in a side wall area which is adjacent an under side of the barrier until encountering a point of contact of a tangent in the convex area. A step off-set relative to the circumferential curve has been provided in the area of each side wall which off-set in its lower area forms an edge at the circumferential curve and in its upper area is at least almost curved constantly and merges into the circumferential curve.

11 Claims, 3 Drawing Sheets

TRAFFIC BARRIER FOR GUIDANCE INSTALLATIONS

During road construction, especially in working areas of highways and Interstates, the traffic flow frequently has to be guided past the usual traffic lanes on deviating or detouring routes. Oftentimes, the width of the remaining traffic is too narrow to successfully separate the oppositely moving traffic flows by means of wide lane strips using traffic lane dividers of some greater height or using barricades. Mostly, guidance installations of a reduced height construction are being used. On the other hand, even when lane dividers or barricades of greater height can be erected, very often guidance installations of lower height are being preferred because the tunnel-vision effect on the vehicle operator caused by high lane dividers or a series of barricades closely following each other, is substantially reduced.

In a known guidance installation of medium height (DE-U-89 15 305.0), longitudinally extending traffic barriers having quad-like or prismatic shaped base bodies are prevalent and having on each of their upper sides a hood-like guide body installed thereon by means of coupling device. These traffic barriers can be connected to each other in an uninterrupted row by means of a further coupling device whose parts are subdivided into two groups with one group each being provided at each of the end faces of the traffic barriers. Thereby, the traffic barriers can be coupled to each other in a longitudinal direction in a form-locked manner. This type of guidance installation is being erected in a two-way traffic mode as a dividing line between the two lanes. Experience has shown that only sharply curved deviated traffic road stretches require that the traffic barriers each must have a guidance hood. With road stretches extending in a straight line, it is generally sufficient to arrange the guide bodies at intervals of three to five meters, that is, every third of fifth guide barrier is supplied with a top guide body.

The traffic barriers have a length of about one meter, a height of 70 to 100 mm, and on their under sides, generally, a width of about 250 mm. In the area of their upper sides, the traffic barriers are narrower than in the area of their under sides. Therefore, the cross-sectional shapes of the traffic barriers in the area of their side walls show an outline getting narrower from the bottom to the top and toward the center line. At a point of a transition toward the under side, there is located a vertically extending section having within an outline of its cross-section a height of about 15–25mm. Thereafter follows a convexly curved section having a relatively small radius of curvature. "Thereafter follows a concavely curved section having a reduced curvature which again is followed by a convexly curved section having unincreased curvature which then will merge into a straight and horizontal section of the upper side".

The relative low height of the traffic barrier makes it possible that a rolling vehicle wheel approaching the traffic barrier in a not too acute angle can relatively easy roll onto the traffic barrier and over the same without causing the vehicle to deviate from its direction of travel to a noticeable extent. The above described outline of the cross-section in the area of the side walls, additionally facilitates the act of rolling onto and over the traffic barrier of the vehicle wheel involved. Thereby, the wheels on one side of a vehicle rolling over a traffic barrier, because of inattention of the driver, can easily be controlled by the driver being able to steer the vehicle back to the correct side of the traffic barrier without fear of inducing a skidding just because of the process of rolling over the barrier.

In a scenario when the wheels on one side of a vehicle roll toward the traffic barrier in a very acute angle, to thereby side-swipe the same to a certain extent, it can happen that because of an elastic deformation of the cross-section of the tire a thus created bulge in the sidewall of the tire is already running against the cross-sectional concavely curved middle and upper section of the side wall of the traffic barrier, even before the riding surface of the tire has rolled onto the lower section of the side wall of the traffic barrier. Thereby, at the least, because of the acute approach angle toward the traffic barrier, a considerable sideways force is created which, because of the absence of a wheel weight, can result in the traffic barrier being pushed sideways. When in the act of touching the traffic barrier several vehicle wheels are involved, such as found on trucks and trailers, the sideways movement can be to a considerable extent resulting in quite a narrowing of the oppositely extending traffic lane on the other side of the guidance installation. The deviation of the guidance installation from its predetermined and extended line can be very irritating for all traffic participants, especially on that side of the guidance installation where the installation has been pushed into an undesirable configuration.

It is an object of the invention to construct a traffic barrier for use in guidance installations or the like, wherein the danger of being pushed sideways by vehicle wheels side-swiping the same has at least been reduced if not eliminated.

Due to the fact that the circumferential curve of the cross-sectional shape of the traffic barrier has a nearly constant extent which is only straight in the lower section adjoining the under side of the area of the side wall but being otherwise convexly curved thereafter, there is avoided that a bulge in the side wall of a tire reaches the side wall of the traffic barrier sooner than the shoulder of the tire reaching the lower part of the side wall of the barrier. Thereby, the corresponding vehicle wheel begins to roll onto the traffic barrier before the side wall of the tire has a chance to push the traffic barrier aside. Due to the fact that in the area of the side wall of the traffic barrier a protruding step is available when compared to the circumferential curvature, the rolling of the vehicle wheel onto the traffic barrier is facilitated so that the barrier is already weight-loaded by means of the vehicle wheel at the beginning of a side-swipe so that a pushing aside of the traffic barrier is avoided. This protruding step acts as a climbing step for the vehicle wheel to a certain extent. This equally applies to the rolling-onto, rolling-over, and rolling back to the correct traffic lane, for the vehicle wheel. As soon as the tire, with the aid of the climbing step, has partially climbed onto the traffic barrier, the complete rolling onto act is facilitated because of the continuing convex outline of the circumferential curvature.

By shaping the traffic barrier according to claim 2, any outwardly protruding wall sections of each of the side walls have been eliminated. Thereby, any danger of the tire side walls side-swiping the climbing step has been eliminated before the tire has a chance to roll onto the climbing step.

By shaping the traffic barrier according to claim 3, the number of climbing steps has been increased so that a climbing-up of the side-swiping vehicle wheel is further facilitated.

By shaping the traffic barrier according to claim 4, a shortening of the transition from the side wall to the upper side is obtained so that the upper side per se can be formed somewhat wider. This will benefit the construction and arrangement of coupling parts to be used when connecting guide bodies thereto. This is further supported according to claim 5, which is a further development of the traffic barrier wherein the curvature of the circumferential curve in the area of the upper side has greatly reduced if not flattened all together.

The invention will be described with its several embodiments as illustrated the drawings.

Figure 1:
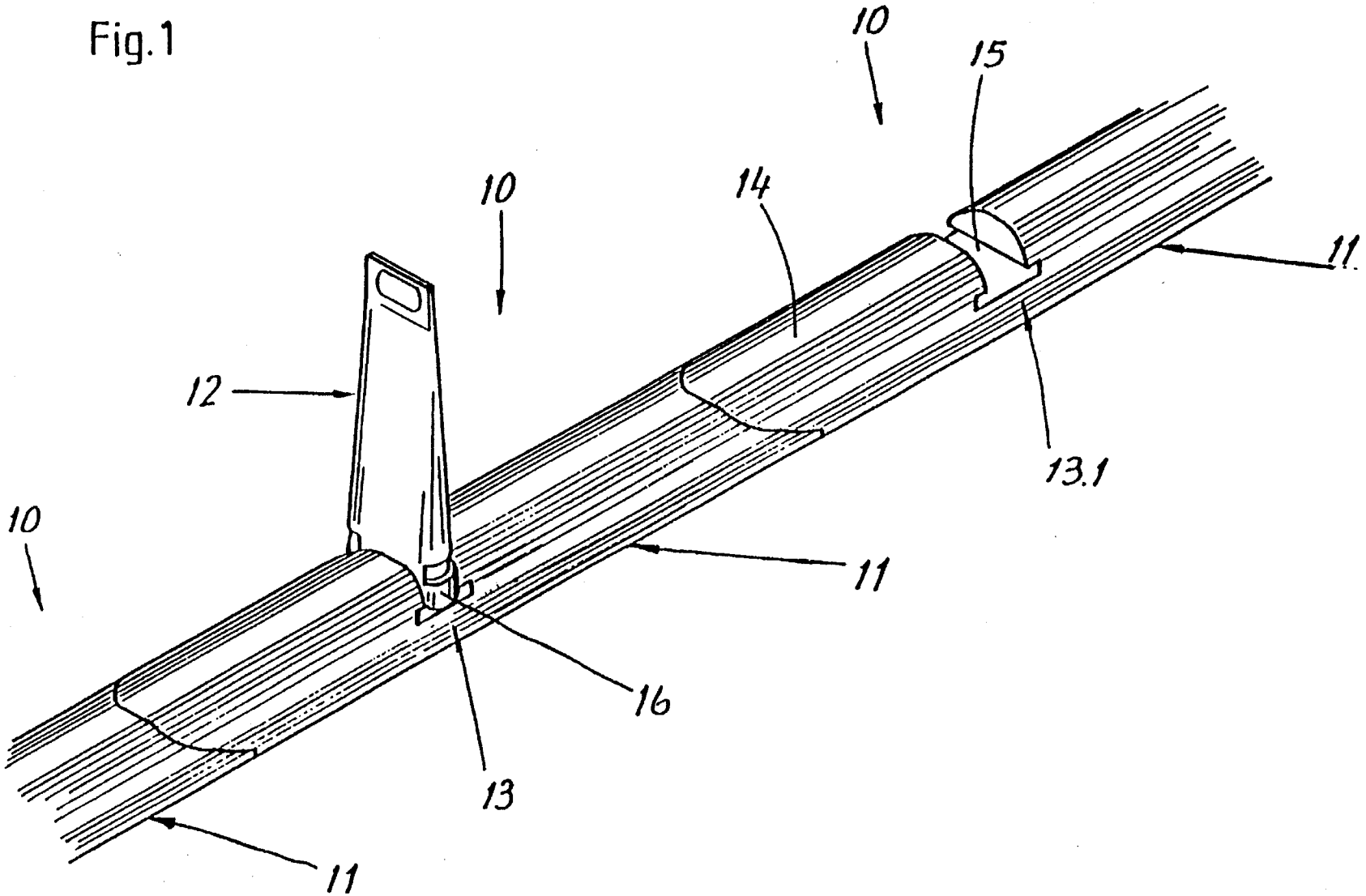
FIG. 1 shows a partial and perspective view of a guidance installation having a group of traffic barriers and at least one guide body thereon.

As shown in FIG. 1, the guidance installation 10 shows at least one each of a traffic barrier 11. Depending on demand, hood-like guide bodies 12 may be included, as can be seen in FIG. 1 on the center traffic barrier 11. Such a guide body 12 is separably connected to the corresponding traffic barrier 11 by means of a coupling device 13. The part 13.1 provided on the upper side 14 of traffic barrier 11 is a part of the coupling device 13 which is schematically shown in FIG. 1 and has as its most important detail a recess 15 extending normal to the longitudinally extending traffic barrier whose outline is an up-side-down T-shape. The guide body 12 shows a foot 16 whose outline corresponds to the outline of recess 15. Both corresponding ribs of foot 16 are hidden from view in FIG. 1 by parts of the coupling device 13.1.

Figure 2:
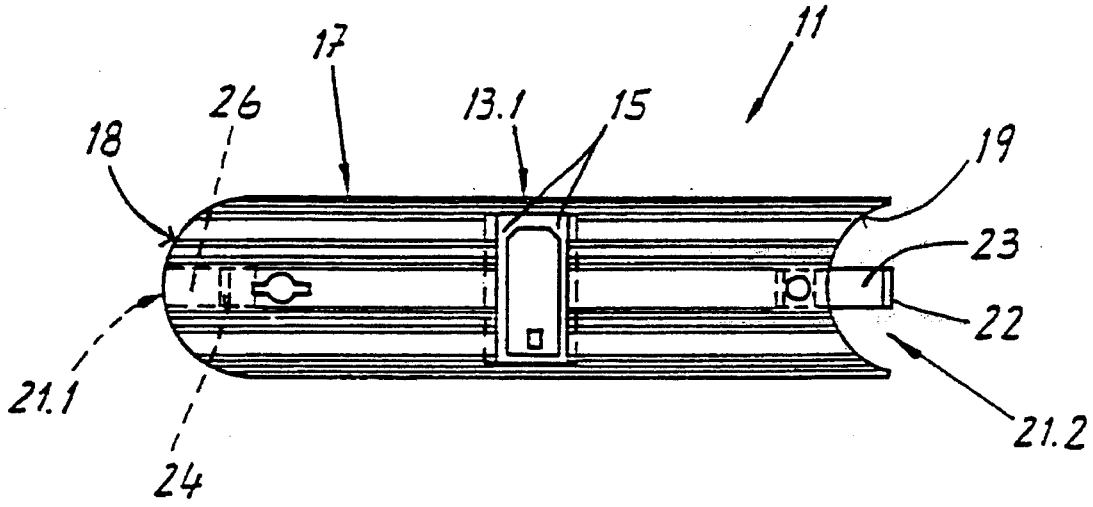
FIG. 2 is a top view of a traffic barrier.
Figure 3:
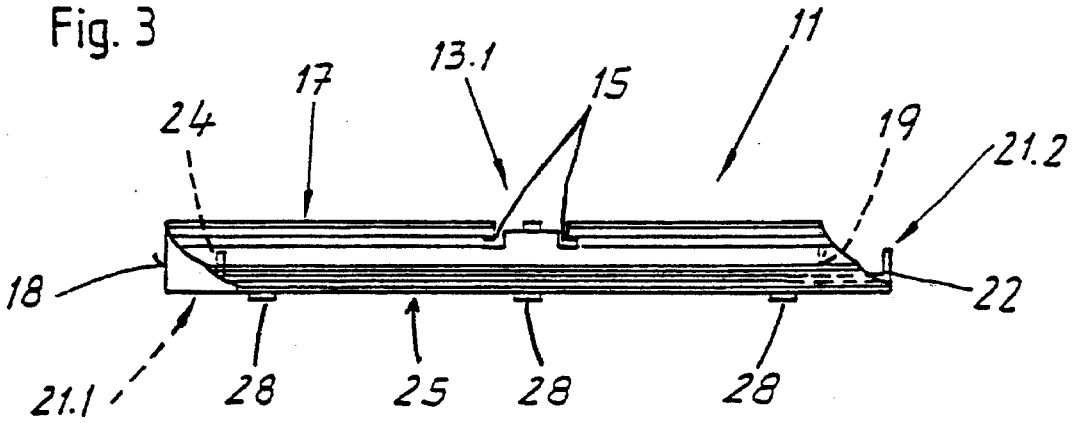
FIG. 3 is a side view of a traffic barrier.
Figure 4:
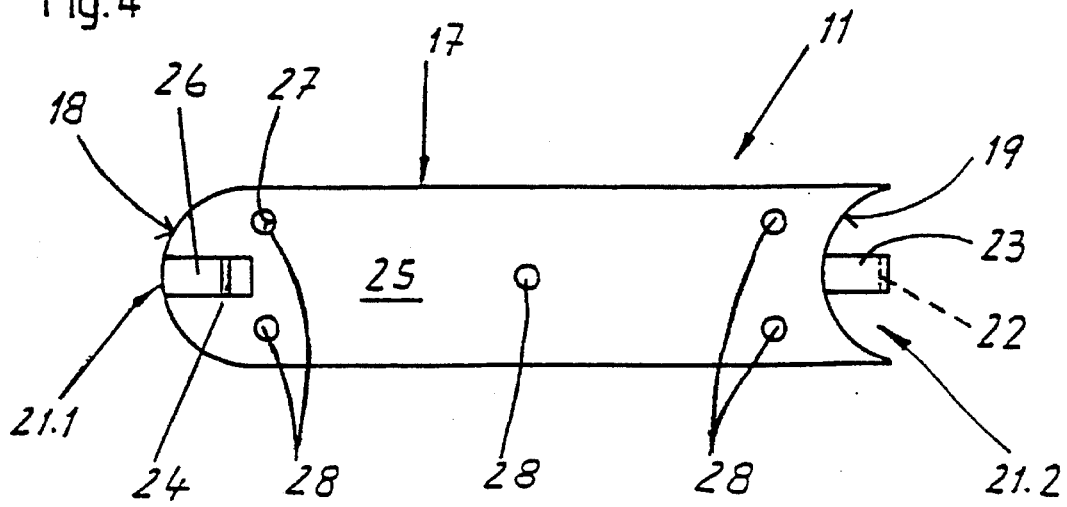
FIG. 4 is a bottom view of a traffic barrier.

Each traffic barrier 11 shows, as its main part, a longitudinally extending base body 17 of a quad-like or prismatic shape in a narrowing sense. As can be seen from FIGS. 2 to 4, both of its end surfaces are substantially vertical. As can be seen, especially in FIG. 3, both end surfaces, in their outline, are curved like sectors of a circle, that is, the in FIG. 3 shown end surface 18 on the left being convex and the in FIG. 3 shown end surface 19 on the right being concave. The curvature radius of both end surfaces 18 and 19 is substantially the same so that they will closely fit into each other when the traffic barriers are assembled into a longitudinal row, as can be seen in FIG. 1.

The traffic barriers are provided with further coupling devices 21 by means of which each the traffic barriers can be coupled to a neighboring barrier in a form-locked manner and be separated again.

The parts of the coupling device 21 are divided into two groups on the base body 17 with one of the groups 21.1 being arranged on the end area having the convexly curved end surface 18 and the other group 21.2 being arranged on the end area having the concavely curved end surface 19.

Associated with parts group 21.2 is a vertical and upwardly directed coupling member 22 which is arranged at the end of a holding bracket 23. The holding bracket 23 is formed as a section of a steel rod whose one end is bent at a right angle to form the coupling member 22. At the opposite end of the holding bracket 23, the steel rod is bent twice at right angles to thereby form a hook-like end. By means of this end, the holding bracket is formed into and anchored in the basic body 17 during its manufacture.

Associated with parts group 21.1 is a vertical and upwardly directed recess 24 on the underside 25 as well as a thereafter continuing groove 26. The recess 24 has a rectangular outline surface, comparable to the coupling member 22, however, somewhat larger when compared to the on-line area of the coupling member 22 to enable a turning movement up to 1° between the two parts around a vertical axis. The groove 26 is attuned to the shape of the holding bracket 23 so that the latter can be fully received in the former. Thereby, the outline surface of the recess is just enough larger relative to the holding bracket 23 to enable a relative pivoting movement of up to 1° between the two parts around the vertical axis of coupling member 22.

The base body 17, on its underside 25, has a number of circular recesses 27 into which foot knobs 28 have been inserted. The foot knobs 28 protrude from the underside by about 3 to 5 mm downwardly from the base body so that the traffic barrier, when installed on hardened streets or other places, generally is only supported by the foot knobs 28.

The foot knobs 28 mainly serve to increase the slide stability of the traffic barrier or, with other words, to serve to increase the resistance against sliding when the traffic barrier 11 is subjected to lateral pushing forces. Therefore, the foot knobs are manufactured of a material of lesser hardness than the material of the base body 17. For this purpose, the foot knobs are made of a homogenous caoutchouc or of a man-made material which on one side exhibits a great tear resistance and on the other side exhibits a minimal form stability, meaning, the foot knobs are elastic and very yieldable but at the same time are quite tenacious. Because of the minimal form stability, the material of the foot knobs 28 adapts itself by pushing itself into any unevenesses of the road surface, whereby an additional form lock is obtained.

Figure 5:
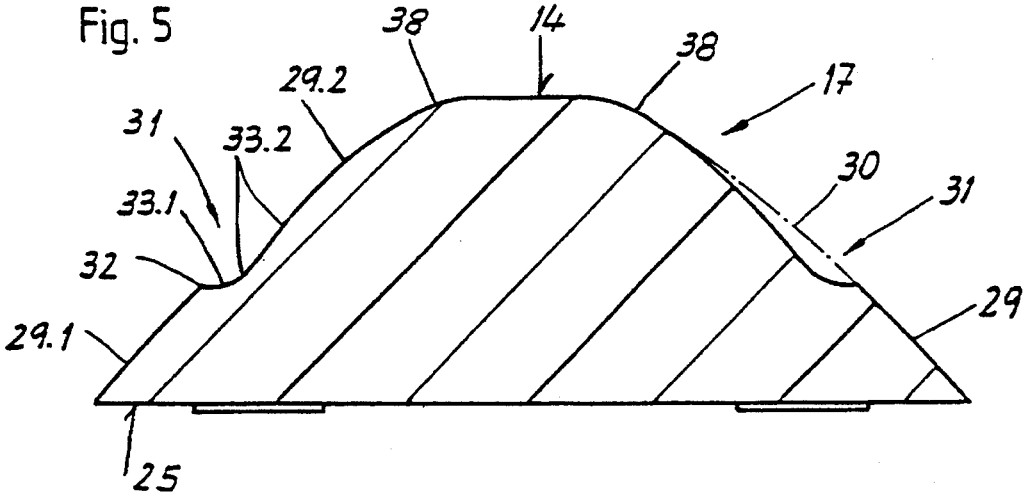
FIG. 5–7 show cross-sections of several different embodiments of the traffic barrier.

As can be seen in FIG. 5, the base body 17 has a cross-sectional shape wherein the side walls and the upper wall merge into each other along an imaginary curve 30 of its circumference at an at least almost constant curvature. The circumferential curve 30 is in the area of the upper side 14 and in the area of the side walls 29 continually and convexly curved, wherein in the areas of the lower sections 29.1 of the side walls, that is, adjacent the under side 25 of the base body 17, the curvature reduces. The circumferential curve 30 can be extending linearly at this lower section 29.1 up to a tangent with the preceding curve section 29.2.

In the area of side wall 29, a step 31 has been provided which is off-set from the circumferential curve 30. This step 31 is off-set inwardly or backwardly in relation to curve 30. At the point of transition between the lower section 29.1 of side wall 29 and the step 31, an edge 32 is present. The thereafter following first section 33.1 with its outline 33 of step 31 is at least almost horizontally directed. The further section 33.2 of the outline 33 of step 31 extends initially into a concave curve and thereafter merges with a convex curvature into the upper section 29.2 of the outline of sidewall 29, that is, into the circumferential curve 30.

The step 31 of the outline of the base body 17 serves as a climbing step for vehicle wheels which are side-swiping the traffic barrier 11 at an acute angle or are rolling toward the barrier at a somewhat less acute angle. By means of this climbing step 31, the climbing on and rolling onto the traffic barrier of vehicle wheels is facilitated. Thereby, a simultaneous and immediately weight loading of the traffic barrier eliminates a chance of the traffic barrier 11 from being pushed aside.

Figure 6:
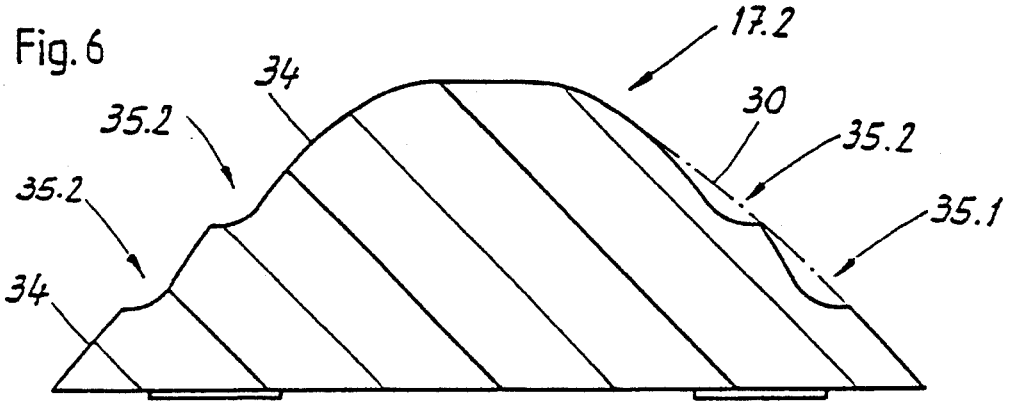
Figure 7:
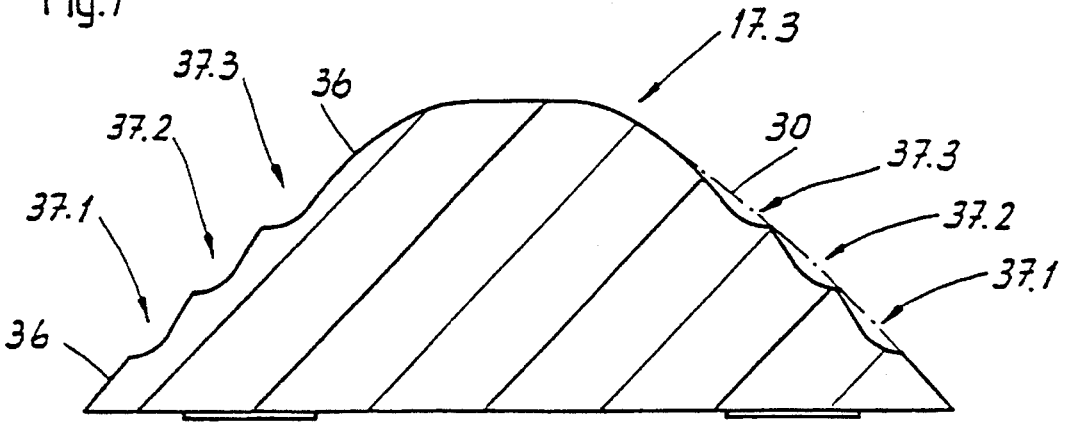

The in FIG. 6 illustrated base body 17.2 shows two steps 35.1 and 35.2 in the areas of both side walls, which are shaped almost in the same manner as step 31 and are also off-set inwardly relative to the common circumferential curve 30 of base body 17.2. In a similar manner, the in FIG. 7 illustrated base body 17.3 shows three steps in the areas of the side walls 36 which are off-set inwardly relative to the circumferential curve 30.

The circumferential curve 30 can have an almost constant curvature on its upper side 14 until encountering section 29.2 of side wall 29. In order to obtain a somewhat flatter and thereby wider upper side 14, the section 38 lying at the transition from the upper side 14 to the sidewalls 29 of circumferential curve 30 can have a sharper curve and, therefore, the curved section of the upper side 14 will have a lesser or more depressed curvature. As an extreme example, the upper side 14 can be extended in a linear manner between points of contacts of tangents of both transitional sections 38.

What I claim is:

1. A traffic barrier for use in guidance installations on a road surface having stability upon contact by a tire, the traffic barrier comprising an elongated body comprising an upper surface, a lower surface, and sides, wherein at least one side comprises a side-wall engaging tire-climbing edge, the edge providing traction between the body and the tire and being configured so that the tire will engage said edge before any other portion of the barrier.

2. A traffic barrier as in claim 1, wherein said at least one side comprises a step which terminates on one side in said edge and wherein the step terminates at the tire-climbing side of said body.

3. A traffic barrier as in claim 2, wherein said step comprises a substantially horizontal portion proximate to the edge.

4. A traffic barrier as in claim 1, wherein the upper surface of said body is substantially flat.

5. A traffic barrier for use in guidance installations on a road surface having stability upon contact by a tire, the traffic barrier comprising an elongated body comprising an upper surface, a lower surface, and sides, wherein at least one side comprises a plurality of tire-climbing edges, the plurality of tire-climbing edges providing traction between the body and the tire.

6. A traffic barrier as in claim 5, wherein at least one side comprises a step terminating on one side in a tire-climbing edge.

7. A traffic barrier as in claim 6, wherein said step comprises a substantially horizontal portion proximate to the side-wall engaging tire-climbing edge.

8. A traffic barrier as in claim 5, further comprising foot knobs that protrude downwardly from the lower surface of said body.

9. A traffic barrier as in claim 8, wherein said foot knobs are made of a material of lesser hardness than the material of said body.

10. A traffic barrier as in claim 8, wherein said foot knobs are made of a homogenous caoutchouc.

11. A traffic barrier as in claim 5, wherein the upper surface of said body is substantially flat.

* * * * *

UNITED STATES PATENT AND TRADEMARK OFFICE

CERTIFICATE OF CORRECTION

PATENT NO. : 5,527,127
DATED : June 18, 1996
INVENTOR(S) : Wilhelm Junker

It is certified that error appears in the above-indentified patent and that said Letters Patent is hereby corrected as shown below:

Column 5:

Please replace Claim 1 with the following Claim:

--1. An above-grade traffic barrier for use in guidance installations over a road surface having stability upon contact by a tire, the traffic barrier comprising an elongated body comprising an upper surface, a lower surface, and sides, wherein at least one side comprises a side-wall engaging tire-climbing edge, the edge providing traction between the body and the tire and stabilizing the above-grade traffic barrier upon contact of the tire with the barrier.--

Signed and Sealed this
Third Day of December, 1996

Bruce Lehman

*Attest:*

BRUCE LEHMAN

*Attesting Officer*

*Commissioner of Patents and Trademarks*